US011812857B2

(12) United States Patent
Brown

(10) Patent No.: US 11,812,857 B2
(45) Date of Patent: Nov. 14, 2023

(54) ADJUSTABLE FURNITURE

(71) Applicant: Motus Mechanics Limited, Cheltenham (GB)

(72) Inventor: Paul Brown, Chorley (GB)

(73) Assignee: MOTUS MECHANICS LIMITED, Chorley (GB)

( * ) Notice: Subject to any disclaimer, the term of this patent is extended or adjusted under 35 U.S.C. 154(b) by 262 days.

(21) Appl. No.: 16/307,530

(22) PCT Filed: Jun. 13, 2017

(86) PCT No.: PCT/GB2017/051722
§ 371 (c)(1),
(2) Date: Dec. 6, 2018

(87) PCT Pub. No.: WO2017/216547
PCT Pub. Date: Dec. 21, 2017

(65) Prior Publication Data

US 2019/0142177 A1 May 16, 2019

(30) Foreign Application Priority Data

Jun. 13, 2016 (GB) ..... 1610212

(51) Int. Cl.
*A47C 20/04* (2006.01)
*A47C 20/02* (2006.01)

(52) U.S. Cl.
CPC ..... *A47C 20/041* (2013.01); *A47C 20/027* (2013.01)

(58) Field of Classification Search
CPC ..... A47C 20/00; A47C 20/04; A47C 20/041; A47C 20/048; A47C 20/027;
(Continued)

(56) References Cited

U.S. PATENT DOCUMENTS 139,493 A 6/1873 Bray
638,466 A 12/1899 Kelly
(Continued)

FOREIGN PATENT DOCUMENTS

CA 851 402 9/1970
CA 851402 9/1970
(Continued)

OTHER PUBLICATIONS

SE-510584-C2 English translation (Year: 1999).*
(Continued)

*Primary Examiner* — Justin C Mikowski
*Assistant Examiner* — Amanda L Bailey
(74) *Attorney, Agent, or Firm* — Andrew F. Young; NOLTE LACKENBACH SIEGEL

(57) ABSTRACT

An adjustable bed (10) includes a frame (20) and an adjustable mattress support platform having a plurality of articulated mattress support sections (12-18) pivotally mounted for relative angular adjustment with respect to the frame. The mattress support sections including at least one adjustable backrest support section (12) and at least one adjustable mattress bend support section (13) adjacent to the backrest section, actuator means (40) for effecting co-ordinated pivotal movement of the adjustable mattress support sections for reconfiguring the bed between a flat lowered configuration and a raised configuration for supporting an occupant in flat or raised positions.

18 Claims, 10 Drawing Sheets

(58) Field of Classification Search
CPC ... A47C 20/042; A47C 20/043; A47C 20/045; A47C 20/046; A47C 20/047; A47C 20/08; A47C 20/10; A47C 20/12; A61G 7/015; A61G 7/10
See application file for complete search history.

(56) References Cited

U.S. PATENT DOCUMENTS

| | | | | |
|---|---|---|---|---|
| 912,214 | A | 2/1909 | Ward | |
| 1,238,078 | A | 8/1917 | Ault | |
| 1,414,637 | A | 5/1922 | Gell | |
| 2,497,395 | A | 2/1950 | Cramer, Sr. | |
| 2,859,797 | A | 11/1958 | Mitchelson | |
| 2,954,072 | A | 9/1960 | Fossati | |
| 3,036,862 | A | 5/1962 | Beierbach et al. | |
| 3,086,814 | A | 4/1963 | Fletcher | |
| 3,121,589 | A | 2/1964 | Schliephacke | |
| 3,202,453 | A | 8/1965 | Richards | |
| 3,281,141 | A | 10/1966 | Smiley et al. | |
| 3,369,767 | A | 2/1968 | Greenfield | |
| 3,797,050 | A | 3/1974 | Benot et al. | |
| 3,847,430 | A | 11/1974 | Fletcher | |
| 3,873,152 | A | 3/1975 | Garas | |
| 4,202,062 | A | 5/1980 | Marcyan | |
| 4,212,495 | A | 7/1980 | Gall | |
| 4,332,417 | A | 6/1982 | Mizelle | |
| 4,547,017 | A | 10/1985 | Lescure | |
| 4,635,999 | A | 1/1987 | Simpson | |
| 4,970,737 | A | 11/1990 | Sagel | |
| 4,996,731 | A | 3/1991 | Kruyt | |
| 5,112,109 | A | 5/1992 | Takada et al. | |
| 5,246,266 | A | 9/1993 | Ostergaard | |
| 5,438,723 | A * | 8/1995 | Carroll | A47C 19/122 5/618 |
| 5,469,591 | A * | 11/1995 | Nomura | A47C 20/04 5/613 |
| 5,625,913 | A | 5/1997 | Singleton | |
| 5,640,730 | A | 6/1997 | Godette | |
| 5,669,090 | A * | 9/1997 | Basgall | A61G 7/002 5/617 |
| 5,785,384 | A | 7/1998 | Sagstuen | |
| 5,819,345 | A | 10/1998 | Basgall | |
| 5,862,551 | A | 1/1999 | Oguma et al. | |
| 5,897,462 | A | 4/1999 | St. Germain | |
| 6,059,364 | A | 5/2000 | Dryburgh et al. | |
| 6,101,648 | A | 8/2000 | Sommerfeld et al. | |
| 6,343,392 | B1 | 2/2002 | Becker et al. | |
| 6,568,755 | B1 | 5/2003 | Groening | |
| 6,641,214 | B2 | 11/2003 | Veneruso | |
| 6,739,661 | B1 | 5/2004 | Dukes | |
| 6,957,460 | B2 * | 10/2005 | Horitani | A61G 7/015 5/618 |
| 7,219,958 | B2 | 5/2007 | Yamazaki et al. | |
| 7,390,060 | B2 | 6/2008 | Kristen | |
| 7,445,279 | B2 | 11/2008 | Crum | |
| 7,641,277 | B2 | 1/2010 | Lawson et al. | |
| 7,703,851 | B2 | 4/2010 | Nakaya et al. | |
| 7,997,654 | B2 | 8/2011 | Ferry et al. | |
| 8,303,036 | B2 | 11/2012 | Hankinson et al. | |
| 8,403,415 | B2 | 3/2013 | Lawson | |
| 8,424,964 | B2 | 4/2013 | Campbell et al. | |
| 8,534,758 | B2 | 9/2013 | Rivera | |
| 9,155,388 | B2 | 10/2015 | Robertson | |
| 9,808,385 | B2 | 11/2017 | Robertson | |
| 10,004,334 | B2 | 6/2018 | Robertson | |
| 10,932,584 | B2 | 3/2021 | Brown | |
| 2002/0060483 | A1 | 5/2002 | Yoshida et al. | |
| 2002/0162170 | A1 | 11/2002 | Dewert | |
| 2002/0174487 | A1 | 11/2002 | Kramer et al. | |
| 2003/0106154 | A1 * | 6/2003 | Takeuchi | A47C 20/04 5/618 |
| 2003/0172455 | A1 | 9/2003 | Roma et al. | |
| 2004/0155504 | A1 | 8/2004 | Tada | |
| 2004/0194213 | A1 * | 10/2004 | Weinman | A61G 7/015 5/618 |
| 2005/0028281 | A1 * | 2/2005 | Ooyama | A61G 7/015 5/619 |
| 2005/0210588 | A1 | 9/2005 | Loewenthal | |
| 2006/0143827 | A1 | 7/2006 | Wilming | |
| 2006/0225201 | A1 | 10/2006 | Kristen | |
| 2007/0120409 | A1 | 5/2007 | Leeds | |
| 2007/0158980 | A1 | 7/2007 | LaPointe et al. | |
| 2007/0174487 | A1 | 7/2007 | Busey | |
| 2008/0150329 | A1 | 6/2008 | Lawson | |
| 2008/0258512 | A1 | 10/2008 | Rogers | |
| 2009/0044339 | A1 | 2/2009 | Morin et al. | |
| 2009/0178201 | A1 | 7/2009 | Lujan et al. | |
| 2011/0248530 | A1 | 10/2011 | Sartisohn | |
| 2012/0240337 | A1 | 9/2012 | Shih | |
| 2014/0041121 | A1 | 2/2014 | Shan | |
| 2014/0103688 | A1 | 4/2014 | Wilson | |
| 2016/0037936 | A1 | 2/2016 | Nomura et al. | |
| 2018/0042392 | A1 | 2/2018 | Brown | |
| 2019/0142177 | A1 | 5/2019 | Brown | |
| 2020/0154888 | A1 | 4/2020 | Brown | |
| 2020/0154899 | A1 | 5/2020 | Brown | |

FOREIGN PATENT DOCUMENTS

| | | | | |
|---|---|---|---|---|
| CA | 2552475 | | 7/2004 | |
| CH | 597799 | | 10/1975 | |
| CN | 202314169 | | 7/2012 | |
| CN | 203538846 | | 4/2014 | |
| DE | 19508907 | | 10/1996 | |
| DE | 029715343 | | 1/1998 | |
| DE | 010152227 | | 5/2003 | |
| DE | 20 2003 015 235 | | 1/2006 | |
| DE | 20 2005 015 275 | | 1/2006 | |
| DE | 20 2007 009 068 | | 12/2007 | |
| DE | 10 2007 024 218 | | 11/2008 | |
| DE | 102007024218 | | 11/2008 | |
| DE | 10 2007 049 118 | | 2/2009 | |
| EP | 1114597 | A1 | 11/1995 | |
| EP | 0781518 | | 12/1996 | |
| EP | 0 774 223 | | 5/1997 | |
| EP | 0774223 | A1 | 5/1997 | |
| EP | 0781518 | A1 * | 7/1997 | A47C 20/08 |
| EP | 0865960 | | 3/1998 | |
| EP | 0865960 | | 9/1998 | |
| EP | 1114597 | | 7/2001 | |
| EP | 1180352 | A1 | 2/2002 | |
| EP | 1 306 032 | | 10/2002 | |
| EP | 1285606 | | 2/2003 | |
| EP | 1 537 805 | | 12/2004 | |
| EP | 1 537 805 | | 6/2005 | |
| EP | 1613195 | | 1/2006 | |
| EP | 1 621 175 | | 2/2006 | |
| EP | 2 524 623 | | 11/2012 | |
| EP | 3468418 | B1 | 4/2019 | |
| FR | 2780256 | | 6/1998 | |
| FR | 2911485 | | 1/2007 | |
| GB | 0329834 | | 5/1930 | |
| GB | 0414464 | | 8/1934 | |
| GB | 0775679 | | 5/1957 | |
| GB | 2 085 719 | | 8/1980 | |
| GB | 2227932 | | 8/1990 | |
| GB | 2362566 | | 11/2001 | |
| GB | 2418846 | | 12/2006 | |
| GB | 2472920 | | 2/2011 | |
| GB | 2486335 | | 6/2012 | |
| GB | 2472920 | | 2/2014 | |
| GB | 191322022 | | 8/2014 | |
| GB | 2520430 | | 11/2015 | |
| GB | 201610212 | | 6/2016 | |
| GB | 0101239 | | 8/2016 | |
| GB | 2552886 | A | 2/2018 | |
| JP | 36-13946 | | 5/1936 | |
| JP | 01214308 | | 8/1989 | |
| JP | 08-173263 | | 7/1996 | |
| JP | 08-308680 | | 11/1996 | |
| JP | H09187481 | A | 7/1997 | |
| JP | 11-244096 | | 9/1999 | |
| JP | 2001-95858 | A | 4/2001 | |
| JP | 2003-144262 | | 5/2003 | |

(56) References Cited

FOREIGN PATENT DOCUMENTS

| | | | | |
|---|---|---|---|---|
| JP | 2004016558 | A | 1/2004 | |
| SE | 510584 | C2 * | 6/1999 | ..... A47C 20/08 |
| WO | WO 96/29970 | | 10/1996 | |
| WO | WO-9629970 | A1 * | 10/1996 | ..... A61G 7/018 |
| WO | WO0057828 | A1 | 5/2000 | |
| WO | WO2004107916 | | 12/2004 | |
| WO | WO 2005/051128 | | 6/2005 | |
| WO | WO 2005/107533 | | 11/2005 | |
| WO | WO 2006/023447 | | 3/2006 | |
| WO | WO 2007/124067 | | 11/2007 | |
| WO | WO 2008/129565 | | 10/2008 | |
| WO | WO 2008/132481 | | 11/2008 | |
| WO | WO 2011/021002 | | 2/2011 | |
| WO | WO/2011/021002 | | 2/2011 | |
| WO | WO2011/048384 | | 4/2011 | |
| WO | WO 2012/032305 | | 3/2012 | |
| WO | WO 2012/099061 | | 7/2012 | |
| WO | WO 2013/061259 | | 5/2013 | |
| WO | WO 2013/160758 | | 10/2013 | |
| WO | WO 2014/171253 | A1 | 10/2014 | |
| WO | WO 2014/183112 | | 11/2014 | |
| WO | WO 201/5011432 | | 9/2015 | |
| WO | WO2016/058949 | | 4/2016 | |
| WO | WO 2016/058949 | A1 | 4/2016 | |
| WO | WO 2017/147094 | A1 | 8/2017 | |
| WO | WO 2017216547 | A1 | 12/2017 | |

OTHER PUBLICATIONS

U.S. Appl. No. 15/557,192, Office Action dated Feb. 3, 2020, 24 pages—English.
GB1709407.9, Examination Report, dated May 8, 2019, 4 pages—English.
CN 201680014490.8, Second Office Action dated Dec. 26, 2019, 7 pages—Chinese, 10 pages—English.
Chinese Appln. No. 201780036988.9, Office Action dated Aug. 19, 2020, 10 pages—English, 16 pages—Chinese.
GB 1316684.8, Search Report and Written Opinion, dated Mar. 13, 2014, 7 pages—English.
PCT/GB2015/000315, International Search Report and Written Opinion, dated Jul. 3, 2016, 9 pages—English.
GB 1422032.1, Search Report dated Apr. 29, 2015, 2 pages—English.
GB1319926.0 Search Report dated May 1, 2014, 4 pages—English.
GB1419811.3 Search Report dated Dec. 17, 2014, 7 pages—English.
PCT/GB2014/000452 Search Report and Written Opinion, 9 pages—English.
PCT/GB2015/000314, Search Report and Written Opinion, dated Jul. 3, 2016, 9 pages.
PCT/GB2017/051722, Search Report and Written Opinion dated Sep. 5, 2017, 17 pgs.—English.
Pat. No. GB 1417108.6, Combined Search and Examination Report dated Mar. 26, 2015, 7 pages—English.
EasyCliner® wood-to-the-floor recliner mechanism, 1 page, HomeFurnitureComponents.com, Apr. 10, 2015.
GB1313002.6, Search Report dated Jan. 21, 2014, 4 pages.
PCT/GB2014/000274, Written Opinion dated Jan. 21, 2014, 5 pages.
U.S. Appl. No. 13/390,985 filed Feb. 17, 2012, Office Action dated Jan. 7, 2015, 20 pages.
PCT/GB2010/001565 International Search Report dated Apr. 12, 2011, 6 pages—English.
CN 201680014490.8, Office Action, dated May 8, 2019, 8 pages—English, 8 pages—Chinese.
GB 1709407.9, Office Action dated Dec. 17, 2019, 3 pages—English.
EP Appln. No. 08 737 140.7, European Search Report dated Jan. 6, 2018, 4 pages—Englsih.
PCT/GB2017/051732, International Preliminary Report on Patentability and Written Opinion, dated Dec. 18, 2018, 8 pages—English.
EP 17732159.3, European Examination Report, dated Oct. 22, 2019, 4 pages—English.
CN 201780036988.9, Chinese Office Action, dated May 7, 2021, 21 pages—Chinese; 15 pages—English.
JP 2018-566248, Japanese Office Action, dated Mar. 30, 2021, 5 pages—Japanese, 5 pages—English.
JP Appln. No. JP2018-566248, Office Action dated Sep. 29, 2020, 7 pages—English, 6 pages—Japanese.
U.S. Appl. No. 15/557,192, Office Action dated Nov. 9, 2020, 8 pages.
U.S. Appl. No. 15/557,192, Response to Office Action dated Nov. 13, 2020, 7 pages.
Canadian Pat. Appln.No. 3,026,473 issued Jul. 12, 2022, Office Action, 5 pages—English.
Canadian Pat. Appln.No. 3,026,473 Office Action dated Jan. 16, 2023, 5 pages—English.

* cited by examiner

ADJUSTABLE FURNITURE

CROSS REFERENCE TO RELATED APPLICATIONS

This application relates to, and claims priority from, PCT Ser. No. PCT/GB2017/051722 filed Jun. 13, 2017, the entire contents of which are incorporated herein by reference, which in turn claims priority from Great Britain Ser. No. GB 1610212.1.

FIGURE SELECTED FOR PUBLICATION

FIG. 1

BACKGROUND OF THE INVENTION

Field of the Invention

This invention relates to adjustable beds and in particular concerns adjustable beds having one or more adjustable support sections which can be moved to adjust the configuration of the bed.

Description of the Related Art

US2002/0174487 discloses a hospital bed having adjustable back and thigh sections for supporting the occupant in various positions, for example in a flat horizontal position, in a recumbent or semi-recumbent position or simply with the backrest raised. The hospital bed of US2002/0174487 comprises a frame having a pair of parallel and spaced apart first and second side frame members; a mattress support deck including an adjustable back; a fixed seat section located adjacent to the back section; and, an adjustable thigh section located adjacent to the seat section. The thigh section is movable longitudinally relative to the seat section, to increase the length of the thigh section as it is raised relative to the frame. First and second curved tubes are coupled to respective first and second sides of the back section. A plurality of rollers are coupled to the first and second side frame members, with the rollers being configured to support the first and second curved tubes to permit movement of the curved tubes and the backrest section relative to the frame. A linear actuator is disposed beneath the back rest section and coupled to the first and second tubes to move the back rest section from a horizontal position to an elevated position relative to the frame. Two concentric arcuate tubes are provided on each side of the bed which have a radius of curvature centered on a location which emulates the natural hip pivot of a person lying on the mattress of the bed. The tubes are secured between three rollers on each side of the bed. Two rollers are located on a bottom side of the radially outer tube, that is to say radially outwards thereof, and the third roller is located on a top side of the radially inner tube. Cross-members extend between the tubes. The arrangement provides a so called shear-less pivot mechanism in which the adjustable back section pivots about the natural hip point of the person on the bed.

The arrangement disclosed in US2002/0174487 may be considered heavy, robust and mechanically complex.

One of the drawbacks associated with adjustable beds of the aforementioned type is that the angle of elevation (included angle) between the seat and the raised back support section can cause significant operational problems for both the bed and the occupant. In most settings, the angle of adjustment for the backrest will be up to 65 degrees, that is to say the backrest can be raised up to 65 degrees from the notional horizontal plane of the bed, to raise the occupant from a lying position, to a raised position up to 65 degrees maximum. In other arrangements, the maximum angle of inclination may be slightly less, for example 50 degrees, 55 degrees or 60 degrees, as dependent on the particular application, whether the bed is for domestic, care home or medical use.

In a modern domestic setting, where mattress thicknesses of 12-18 inches are common, and more typically 14-18 inches in the United States, the overall weight, stiffness and rigidity of the mattress can place an unacceptable load on the operating mechanism of the bed, for example thicker, heavier mattresses can cause the motor (actuator) to struggle and reduce the longevity of the motor and mechanism. This is becoming increasingly relevant as the market place is driven by customer demand for thicker mattresses. Motorized adjustable beds have been known to fail after a short number of cycles using mattresses of the afore-mentioned thickness. One way to overcome this has been to use special, more flexible, "ribbed" mattress. However, this is not a practical solution for most applications.

A further problem associated with known designs is that the angle of elevation between the seat and the raised back support section is not ideal ergonomically, as it does not allow the mattress to naturally crease around the user's hip joint, so the user has to continually adjust their position as the back rest lifts.

There is a requirement for an adjustable bed which addresses the aforementioned problems associated with known designs.

Further, there is a particular requirement for an adjustable bed which is at least as easy to manufacture, store, transport, deliver and assemble as non-adjustable beds of known designs.

ASPECTS AND SUMMARY OF THE INVENTION

According to an aspect of the present invention there is provided an adjustable bed comprising a frame and an adjustable mattress support platform having a plurality of articulated mattress support sections pivotally mounted for relative angular adjustment with respect to the frame, and a fixed seat section, said mattress support sections including at least one adjustable backrest support section and at least one adjustable mattress bend support section adjacent said backrest support section, an actuator mechanism for effecting co-ordinated pivotal movement to angularly adjust the at least one adjustable backrest support section relative to the at least one adjustable mattress bend support section for reconfiguring the bed between a flat lowered configuration and a raised configuration for supporting an occupant in flat or raised positions.

The above aspect of the invention provides for one or more intermediary short platform sections (mattress bend support section(s)) between seat and back rest platforms to form an approximate curve, of discrete straight lines, as the back rest and mattress bend support sections are raised. This more gently bends the mattress and does not force the mattress to conform to a sharp obtuse angle as in hitherto known arrangements. When the bed is raised the upper surface of the mattress is therefore more ergonomic, gradually curved and more consistent with human anatomy and the natural pivot point of the hip joint (and does not require the user to adjust position as the bed is raised). Less force from the actuator is necessary as it is easier to bend the mattress over a larger distance than to crease it at a sharp point. This has the attendant effect of reducing wear and tear on the operating mechanism, including the motor(s)/actuator(s) of a powered adjustable bed.

In preferred embodiments, the combined range of adjustment of said backrest and mattress bend support sections is 65 degrees or less with respect to the flat lowered configuration of the bed.

The combined range of adjustment of the backrest and mattress bend support sections may be 60 degrees or less with respect to the flat lowered configuration of the bed.

In other embodiments, the combined range of adjustment of the backrest and mattress bend support section may be 55 degrees or less with respect to the flat lowered configuration of the bed.

In further embodiments, the combined range of adjustment of the backrest and mattress bend support sections may be 50 degrees or less with respect to the flat lowered configuration of the bed.

Preferably, the angular range of adjustment of the backrest support section and the angular range of adjustment of the mattress bend support section are substantially equal.

In other embodiments, the angular range of adjustment of the backrest support section is greater than and the angular range of adjustment of said mattress bend support section.

The adjustable bed of the present invention may comprise a plurality of adjacent adjustable mattress bend support sections. The above aspect of the invention therefore contemplates embodiments having a plurality of adjustable mattress bend support sections which combine to provide an approximate curve of discrete sections to define a gentle curvature of mattress support sections on the underside of the mattress as the bed is adjusted and the mattress raised and lowered.

The adjustable bed of the present invention may comprise a plurality of adjacent adjustable backrest support sections. The above aspect of the invention therefore contemplates embodiments having a plurality of adjustable backrest support sections which combine to provide an approximate curve of discrete sections to define a gentle curvature of mattress support sections on the underside of the mattress as the bed is adjusted and the mattress raised and lowered.

Preferably, the adjustable bed of the present invention further comprises at least one non-adjustable support section fixed in relation to the frame.

In preferred embodiments, the mattress bend support section is disposed between the non-adjustable mattress support section and the backrest support section.

In particular, the above aspect of the invention contemplates embodiments without complex and expensive actuating elements. This aspect of the invention can achieve significant weight and cost advantages without compromising performance and durability. This is a particular consideration in the domestic furniture industry where manufacturing cost is often of critical importance to product success in the marketplace. A significant advantage of this aspect of the present invention is that the profile of the bed, that is to say the depth dimension of the bed, can be minimized, and thereby a low profile adjustable bed can be realized with attendant storage and shipping cost advantages. Particularly when compared with hitherto known designs, due to a smaller depth dimension of the bed and actuation system. In this respect, it will be understood that the depth dimension for shipping purposes is the depth of the bed minus legs or other support means which are shipped unassembled. Thus, the reduced depth dimension readily enables greater number of units to be shipped in a given space, such as an ISO (intermodal type) container or the like.

Another aspect of the invention provides an adjustable bed comprising a frame and at least one adjustable body support section including at least an adjustable backrest support section pivotally mounted for angular adjustment with respect to the frame. The frame comprises at least two hinged sections including a head end sub-assembly configured as an upper body supporting section on which the mattress bend and backrest support sections are mounted, and a separate toe end sub-assembly configured as a lower body supporting section hinged with respect to the upper body supporting section. Actuator means is disposed within at least the upper body section for angular adjustment of the adjustable body support sections. The head end sub-assembly and the toe end sub-assembly are capable of being folded together to reduce the length dimension of the bed for transportation and/or storage purposes and subsequently unfolded to provide a full length adjustable bed.

The upper body section may further comprise a fixed support section adjacent to the backrest support section, the fixed support section being fixed in relation to the frame adjacent the hinged end of the backrest section to provide at least part of a fixed seat section of the bed.

The lower body section may further comprise a lower body fixed support section adjacent to the upper body section.

The upper body fixed support section is preferably hingedly connected to the lower body fixed support section.

The lower body section of the frame may be non-adjustable.

The upper and lower hinged body sections of the frame may comprise two separate hinged half sections of the frame.

The adjustable bed may further comprise locking means for locking the respective upper and lower hinged body sections of the frame together when the bed is unfolded for use.

The above and other adaptive and alternative aspects, features, objects and advantages of the present invention will become apparent from the following description read in conjunction with the accompanying drawings, in which like reference numerals designate the same elements.

BRIEF DESCRIPTION OF THE DRAWINGS

An embodiment of the present invention will now be more particularly described, by way of example only, with reference to the accompanying drawings.

DETAILED DESCRIPTION OF THE PREFERRED EMBODIMENTS

Figure 1:
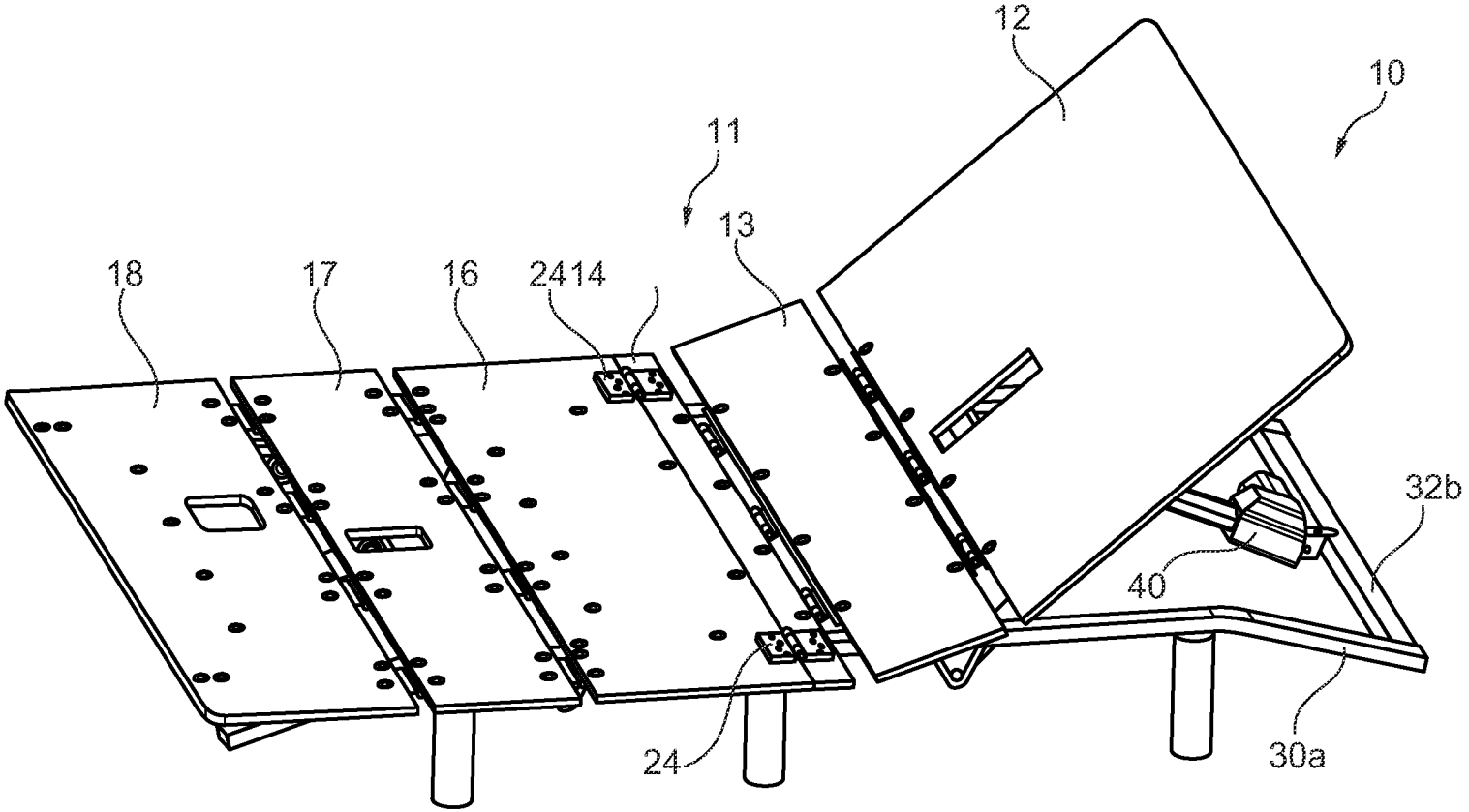
FIG. 1 is a perspective view from above of a frame and operating mechanism of an adjustable bed according to an embodiment of the present invention, with the bed in a semi-upright configuration for supporting an occupant in a seated position.
Figure 2:
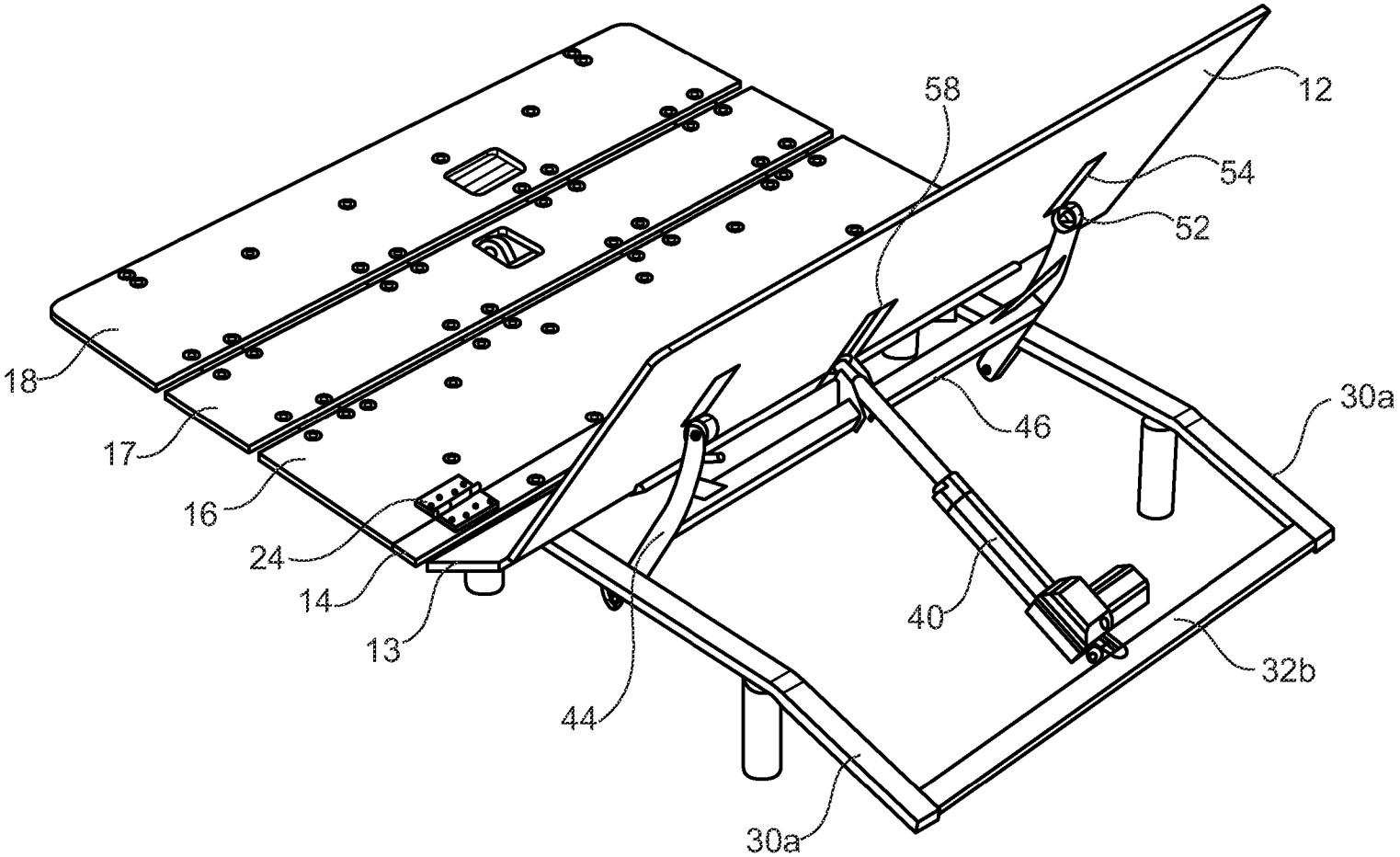
FIG. 2 is a perspective view from above and the rear, left hand side rear quarter, of the frame and operating mechanism of the adjustable bed of FIG. 1.
Figure 3:
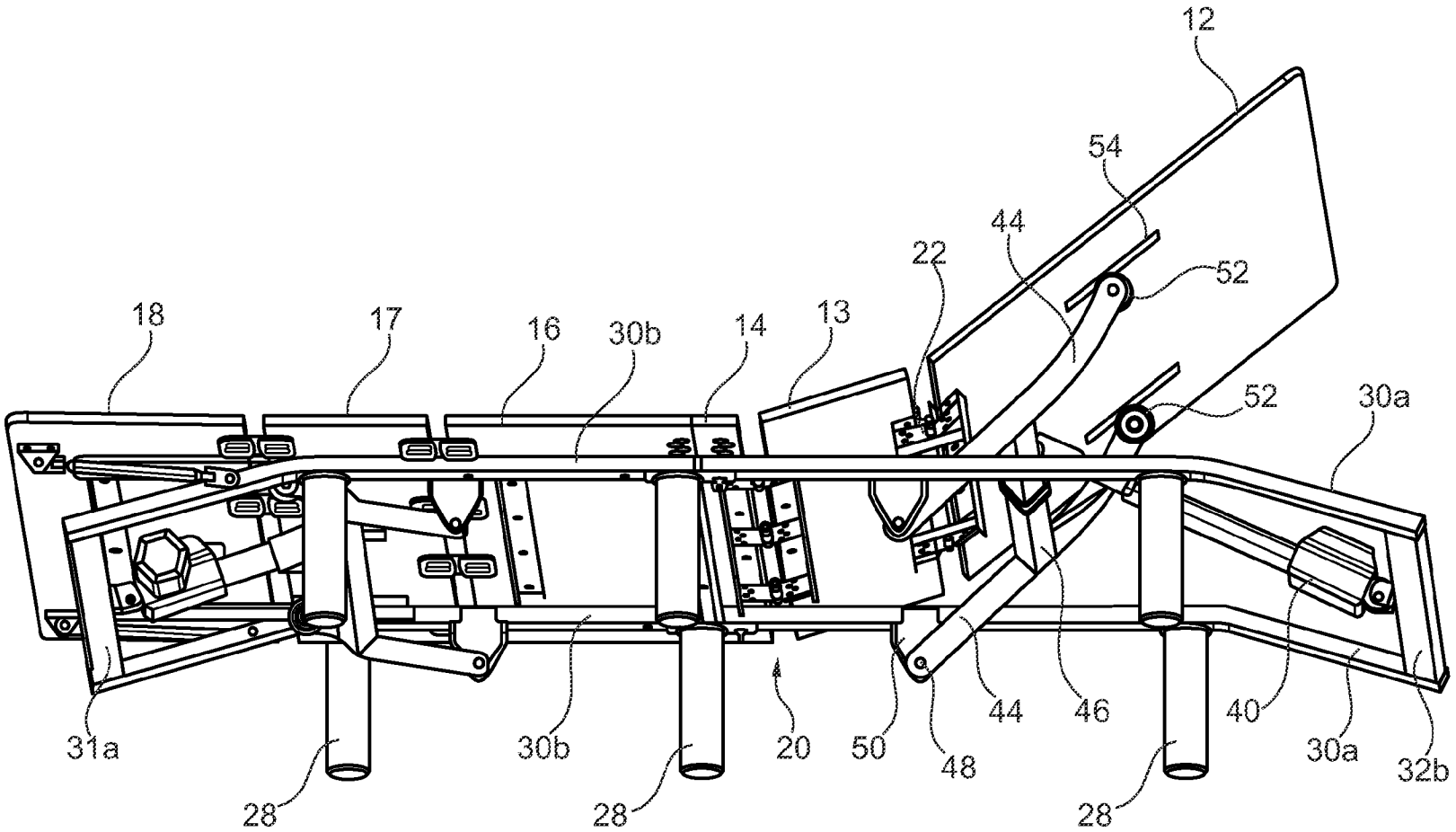
FIG. 3 is a perspective view of the bed of FIG. 1 with the bed viewed from below.
Figure 4:
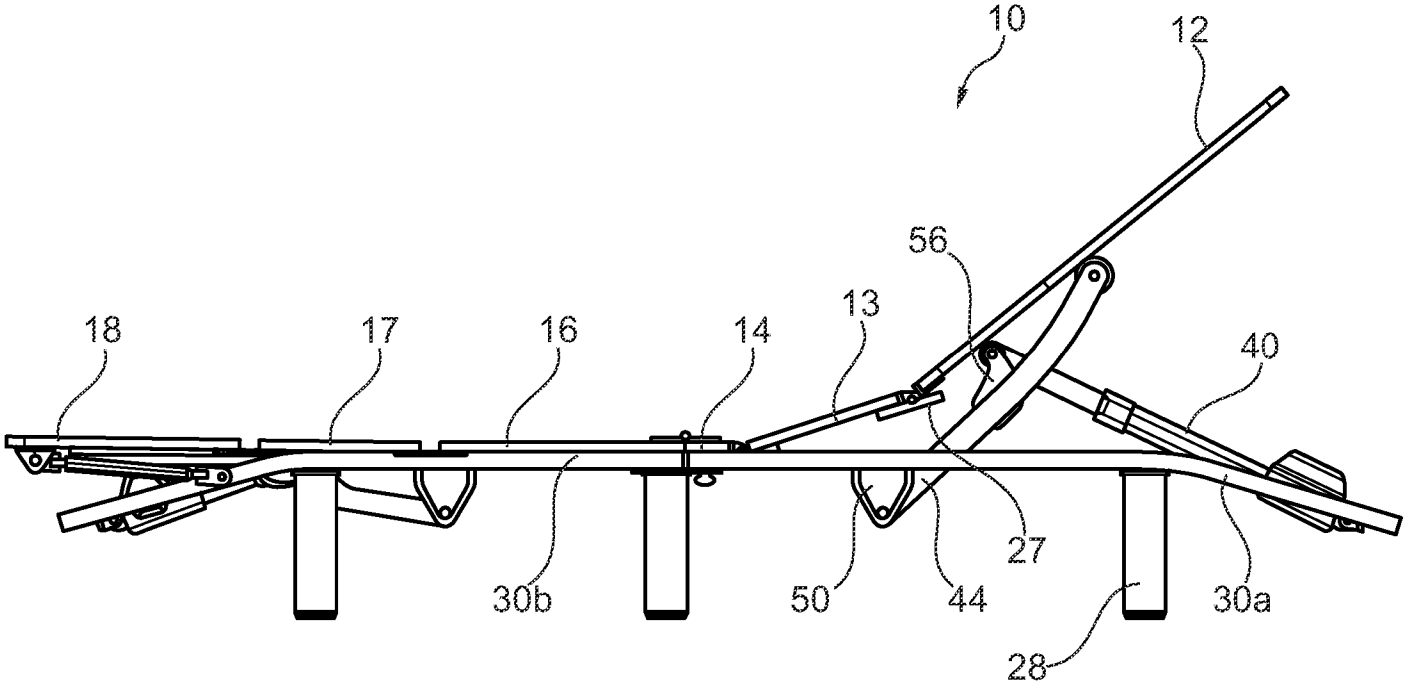
FIG. 4 is a side elevation view of the bed of FIG. 1, with the bed in the semi-upright adjusted position of FIG. 1.

Reference will now be made in detail to embodiments of the invention. Wherever possible, same or similar reference numerals are used in the drawings and the description to refer to the same or like parts or steps. The drawings are in simplified form and are not to precise scale. The word 'couple' and similar terms do not necessarily denote direct and immediate coupling connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto.

Referring to the drawings, FIGS. 1 to 9 schematically show an adjustable bed 10. The bed 10 comprises a mattress support platform or deck 11 having a plurality of adjacent planar mattress support panels, including an adjustable back, neck and head (upper body) support section panel 12, a mattress bend support section panel 13, a non-adjustable intermediate support section panel 14, a non-adjustable lower body support section panel 16, an adjustable thigh section panel 17 and a lower limb and foot support section panel 18. Throughout the drawings of FIGS. 2, 5, and 7 the panels 12-18 are shown in ghost outline in order to reveal the detailed construction of the adjustable bed 10. FIG. 6A shows a bed assembly including the adjustable bed 10 in the position of FIG. 6 with a mattress 50 supported on the deck 11. The mattress 50 is shown slightly elevated above the deck 11 for clarity, although it will be appreciated that the mattress 50 is in direct physical contact with the deck 11 in use. The panels 12-18 are mounted on a support frame 20. The upper body support panel 12 and mattress bend support panel 13 are adjustably mounted on the support frame 20. The intermediate support panel 14 and lower body support section panel 16 are fixed in relation to the frame 20. The thigh support panel 17 and lower limb/foot support panel 18 are adjustably mounted on the support frame 20. The mattress bend support section 13 has an upper surface 19, and the backrest support section 14 has an upper surface 21. An interior angle B, is defined between upper surfaces 19,21, the interior angle B always being less then 180 degrees when the bed moves towards the fully raised configuration such that the backrest section 14 is always tilted towards (anti-clockwise when viewing FIG. 4 such that a head of the occupant (not shown) is supported by the backrest support section.

The frame 20 comprises two half sections 20*a*, 20*b* hinged together at their respective adjacent ends. The two half sections include a head end sub-assembly 20*a* and a toe end sub-assembly 20*b*. The two half sections 20*a*, 20*b* are hinged together at their respective adjacent ends by hinges 24 fixed to the upward facing surface of the panels 14 and 16 at their respective adjacent edges, as can best be seen in FIGS. 1 and 10. The hinge arrangement is such that the two half sub-assemblies provide a full length structural support frame when hinged apart and locked into position, as shown in the drawings of FIGS. 1 to 8. The hinged sub-assemblies 20*a*, 20*b* allow the upper and lower halves of bed to be folded onto one another, as will be described in greater details below, for transportation, storage, distribution and delivery purposes.

The upper body support panel 12 and the mattress bend support section panel 13 are adjustably mounted on the head end support frame sub-assembly 20*a*. The intermediate support panel 14 is fixedly mounted on the head end support frame subassembly 20*a*, adjacent to the mattress bend support panel 13. The lower body panel 16 is fixed in relation to the toe end support frame sub-assembly 20*b* adjacent to the intermediate panel 14. The thigh support panel 17 and lower limb/foot support panel 18 are adjustably mounted on the toe end support frame sub-assembly 20*b* adjacent to the fixed lower body support section panel 16.

The mattress bend support panel 13 is pivotally connected to the fixed intermediate support by means of a hinged joint 22 extending along the respective adjacent edges of the panels. As can best be seen in FIG. 9, the hinged joint 22 comprises a plurality of hinges 22' spaced along the edges of the adjacent edges of panels 13 and 14 within the region of the frame 20. The adjacent edges of the panels 13 and 14 are provided with respective elongate hinge mounting brackets 23*a*, 23*b*, preferably of metal construction, which extend on the underside of the panels 13 and 14 between the sides of the frame 20*a*, as can best be seen in FIG. 8. Three hinges 22' are provided, including a centrally located hinge and a pair at the respective ends of the elongate mounting brackets 23*a*, 23*b*. In the illustrated embodiment, the hinges 22' are conventional design and construction and are fixedly secured to the respective mounting brackets to pivotally mount the mattress bend support panel to the fixed intermediate support panel about the pivot axis of the hinge 22.

The upper body support panel 12 is similarly pivotally connected to the mattress bend support panel by means of a hinged joint 25 extending along the respective adjacent edges of the panels. The hinged joint 25 comprises a plurality of hinges 25' spaced along the edges of the adjacent edges of panels 12 and 13 within the region of the frame 20. The adjacent edges of the panels 12 and 13 are provided with respective elongate hinge mounting brackets 26*a*, 26*b*, preferably of metal construction, which extend on the underside of the panels 12 and 13 between the sides of the frame 20*a*, as can best be seen in FIG. 8. Three hinges 25' are provided, including a centrally located hinge and a pair at the respective ends of the elongate mounting brackets 26*a*, 26*b*. In the illustrated embodiment, the hinges 25' are conventional design and construction and are fixedly secured to the respective mounting brackets to pivotally mount the upper body support panel 12 to the mattress bend support panel about the pivot axis of the hinge 25.

Hinges 22' and 25' may be conventional pin bracket type hinges or, in other embodiments, constructed of a fatigue resistant plastics material, for example as a so called "living hinge". Other types of hinge are also contemplated including extruded metal tubes, for example extruded aluminium or aluminium alloy, having a d or p shape cross-section, including a longitudinal mounting flange as an integral part of the extrusion, where a hinge pin passes through the extruded tube in a known manner and optionally mounted on bearings (ball bearing type) located at the respective ends of the tube to support the hinge pin in a low friction manner. In preferred embodiments, at least hinges 25' are provided with limited angular adjustment so that the adjustable panel 12 has a limited downward angular adjustment with respect to the mattress bend support panel 13. In the illustrated embodiment, the hinge 25 is provided with an abutment stop in the form of a rectangular, preferably metal, plates 27 that are fixedly secured or connected to the hinge mounting bracket 26*a* in the region of the hinges 25'. The plates 27 are positioned on the underside of the hinge 25 and prevent panel 12 being lowered beyond the plane of panel 13 by mutual abutment of the plates 27 and the underside of the mounting brackets 26*b*. Thus, when the panels 12 and 13 are lowered flat they remain 180 degrees apart.

Hinges 22' and 25' are also limited upwards so each platform section 12. 13 cannot go beyond this angle relative to the previous panel section it is hinged to (typically 30 degrees, or the total combined angel of angular adjustment divided by the number of intermediary platform sections). Hinges 22' and 25' are also limited downwards so each platform section cannot fall below parallel to the previous section it is hinged to.

As will be described in greater detail below, panels 12 and 13 may be raised by a predetermined maximum amount about their respective pivot axis during adjustment of the bed, for example 65 degrees, combined, from the horizontal plane as defined by the flat orientation of fixed intermediate support panels 14 and 16 of the bed. Hinges 22 and 25 are provided with stop means to limit the degree of relative angular adjustment of the panels 12 and 13. Typically the maximum combined angular adjustment of the panels is 65 degrees with respect to the plane of the fixed non-adjustable panel 14. The hinges 22 and 25 may thus be adapted so that they contribute to the maximum angular adjustment of the panels 12 and 13 by equal amounts or substantially equal amounts, for example, 50/50 or 40/60 depending on the particular application and maximum angel of adjustment required.

As previously described, in embodiments of the present invention, the maximum combined angle of adjustment of the backrest and mattress bend support sections is typically 50-65 degrees. In the illustrated embodiment, the angle of adjustment is shared between hinges 22 and 25 connecting each side of the mattress bend support platform. The hinge axes are preferably 200-300 mm apart in the longitudinal direction of the bed, as best seen from the view of FIG. 9. In the illustrated embodiment, a single mattress bend support platform having a length dimension of 250 mm is preferred.

Figure 5:
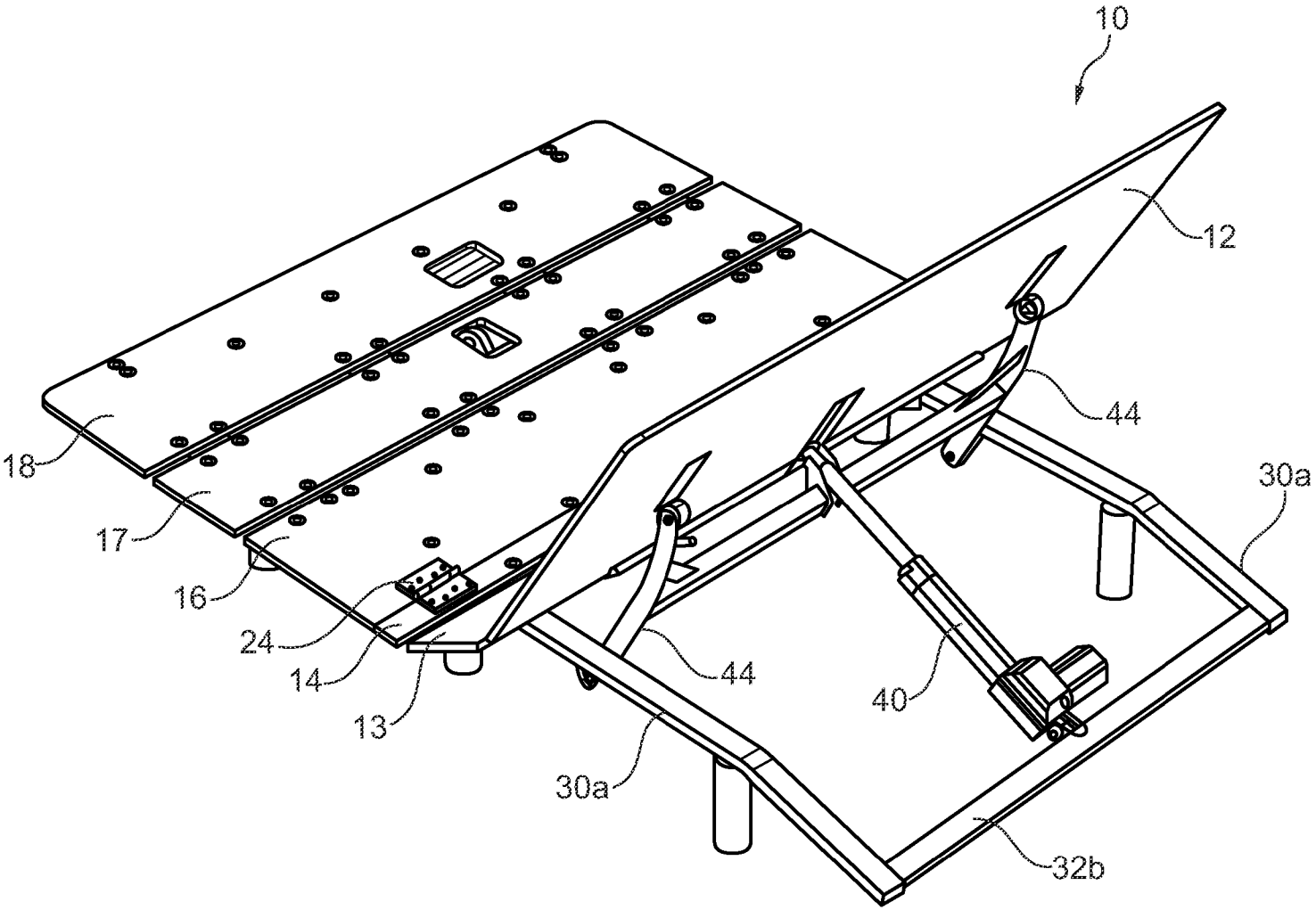
FIG. 5 is a perspective view similar to FIG. 2 with the bed in a fully upright adjusted position.
Figure 6:
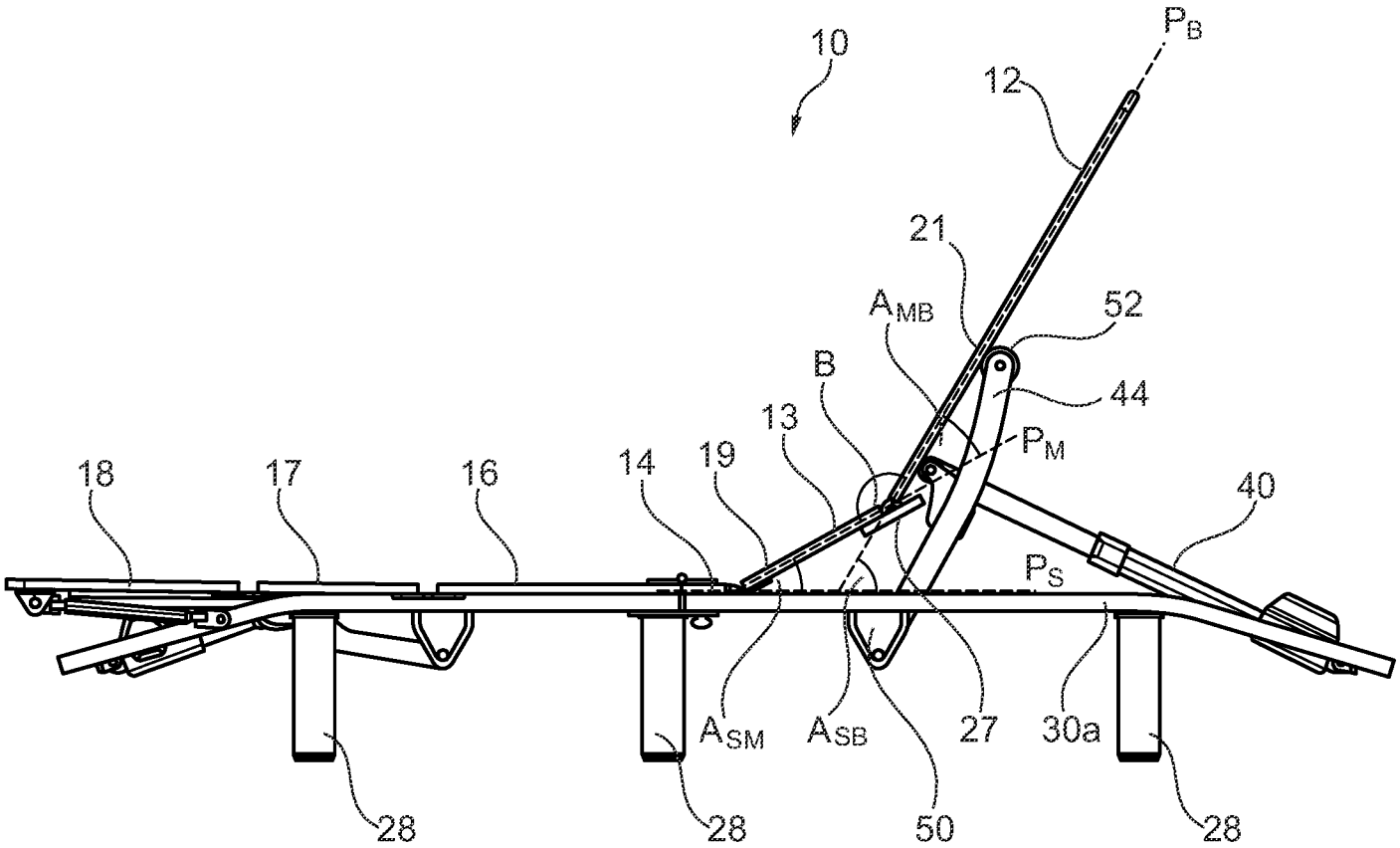
FIG. 6 is a side elevation view of the bed similar to FIG. 4, with the bed in the fully upright adjusted position of FIG. 5.
Figure 6A:
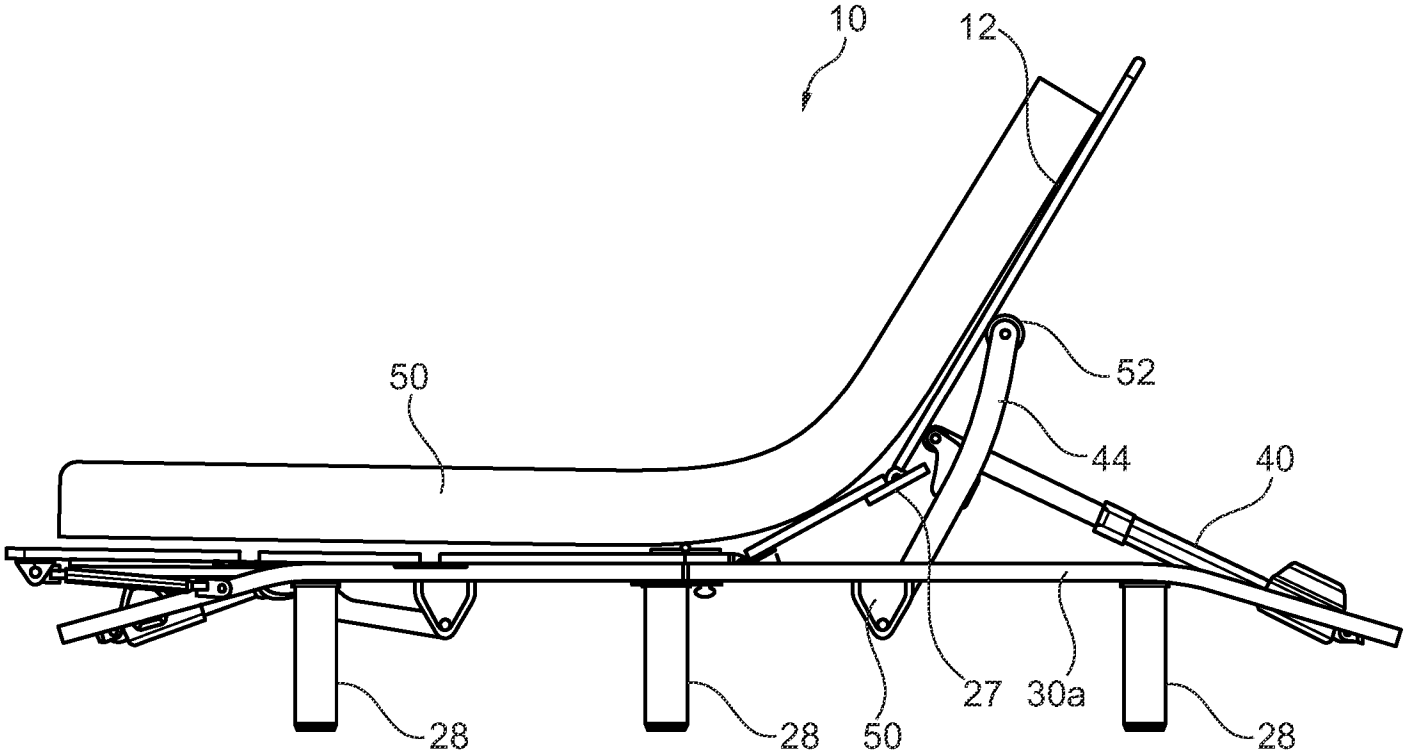
FIG. 6A is a side elevation view of the bed of FIG. 6 with a mattress supported thereon.

In FIGS. 5 and 6 the bed 10 is shown in a fully articulated configuration, adjusted for supporting an occupant in a raised upright seated position. In this position, the upper body support section panel 12 and the mattress bend support section panel 13 are raised, and inclined with respect to, the fixed intermediate support section panel 14. The upper body support section panel 12 is raised about its pivot axis defined by hinge 25 and the mattress bend support panel 13 is raised about its pivot axis defined by hinge 22.

Referring to FIG. 6, it can be seen that the combined angle $A_{SB}$ is defined between a plane $P_S$ defined by the seat section 16 and a plane $P_B$ defined by the backrest support section 12, the combined angle $A_{SB}$ being shared between a first angle $A_{SM}$ defined between the seat section plane $P_S$ and a plane $P_M$ defined by the mattress bend support section 13, and a second angle $A_{MB}$ defined between the plane $P_M$ defined by the mattress support section 13 and the plane $P_B$ defined by the backrest support section 12.

The present invention also contemplates embodiments (not shown) where the lower body support section, or toe end sub-assembly, is non-adjustable, that is to say, non-articulated, or fixed with respect to the frame 20. Embodiments of the present invention may therefore provide a bed having an adjustable upper body section only so that the backrest panel 12 and mattress bend panel 13 may be raised to lift the occupant to a seated position, or a bed additionally having an adjustable lower body support section, which may comprise one or more adjustable and non-adjustable mattress support panels as shown in the illustrated embodiment.

In the lowered position (FIGS. 7 and 8) the adjustable support panels 12, 13, alternatively being a plurality of adjacent adjustable mattress support sections 13*a* or a plurality of adjacent adjustable backrest support sections 12*a* combine with the fixed panel 14 and fixed panel or seat section 16 and adjustable panels 17 and 18 to define a substantially flat planar horizontal mattress support platform or deck 11. The various support panels 12-18 may each have a mattress support cushion (not shown) of pre-determined thickness, which combine to provide a mattress foundation for supporting a suitable mattress. Alternatively, a mattress may be positioned directly on top of the panels 12-16. The panels 12-16 may be upholstered, with or without support cushions. The present invention also contemplates arrangements where the frame 20 is configured to be placed within the internal space of a bed surround, for example of the type common in North America, or integrated in a divan type bed foundation structure, more typically found in the United Kingdom. In the illustrated embodiment, the bed frame 20 is provided with floor standing legs 28 and is thus self-supporting. Thus, the present invention also contemplates arrangements where the frame 20 is arranged to be positioned within a separate surrounding structure, for example a decorative wood or upholstered surround including head and toe boards and lateral side panels between the head and toe boards. The dimensions of the bed are such that the bed has the size of a double bed, but the present invention contemplates beds of many different widths including standard single size beds to much larger doubles.

The half frame sub-assemblies 20*a* and 20*b* each comprises a generally rectangular structural support frame, preferably constructed of metal but other materials may be used for various component parts, in addition to or instead of metal, including board type material, for example engineering plastic, MDF (medium density fiberboard), timber or other fiber type board for example.

The two half sections 20*a* and 20*b* each comprise a pair of elongate parallel lateral side frame members in the form of respective side rails 30*a*, 30*b*. The side frame members extend longitudinally along the length of the bed on both sides thereof and are joined together at their respective ends by metal, preferably steel, cross-members 31*a*, 31*b*, 32*a*, 32*b* to form rectangular box type structural support frames 20*a*, 20*b*.

The side frame members 30*a*, 30*b* are constructed of suitably dimensioned box section metal tube, preferably steel, and the cross-members 31*a* and 32*b* of similar rectangular box section metal tube. The frame 20 is provided with legs 28 towards each of the corners of the rectangular frame structure and at an intermediate position at the end of the toe end sub-assembly 20*b*. The side members 30*a*, 30*b* and respective cross members 31*a*, 31*b* and 32*a*, 32*b* are joined together by welding or alternatively by fixing means such as screws, bolts, fasteners or the like. In preferred embodiments, the legs are attachably/detachably fixed to the frame by suitable reversible fixing means as are well known in the art, for example screw thread fittings.

The two half sub-assemblies 20*a* and 20*b* are provided with locking means for locking the frame members 30*a*, 30*b* together when the frame 20 is unfolded. The locking means comprises a metal plate 33 secured on the underside of the respective side frame members 30*b* in the region of the hinged connection 24. The metal plate 33 extends over the underside of the adjacent side frame member 30*a* and is attachably/detachably fixed thereto by suitable reversible fixing means, as are well known in the art, for example screw thread fittings, such as a butterfly or winged 5 nut/bolt connection 35 as in the illustrated embodiment.

The unfolded and locked support frame 20 constitutes a floor standing base of the bed 10. The frame 20 may stand directly on legs 28 or alternatively be provided with castors, feet or the like at the end of the legs, as is well known in the art. Alternatively, the legs may be removed and the frame adapted to be mounted within a bed surround, for example with the side frame members sitting on a suitable mounting on the inside of a suitably adapted bed surround.

Movement of the adjustable panels 12 and 13 is effected by means of a powered actuation mechanism comprising a linear actuator 40 and a connecting means in the form of a pivotal "H-frame" 42. The H-frame 42 comprises a pair of arms 44 and a cross-member 46 extending between and connecting the arms 44 approximately midway along their length. The H-frame is pivotally mounted on the underside of the head end sub-assembly frame 20*a* at pivot points 48 at the apex of triangular shaped brackets 50 depending from the underside of the frame 20*a* in the region of hinges 25. The arms 44 are generally straight but curve upwards at their distal end where a roller in the form of a bearing 52 is rotatably mounted. The bearings 52 contact the underside of the panel 12 along wear resistant strips 54 which may be of metal, nylon or the like, along which the bearings 52 run when the panel 12 is lowered and raised.

Figure 7:
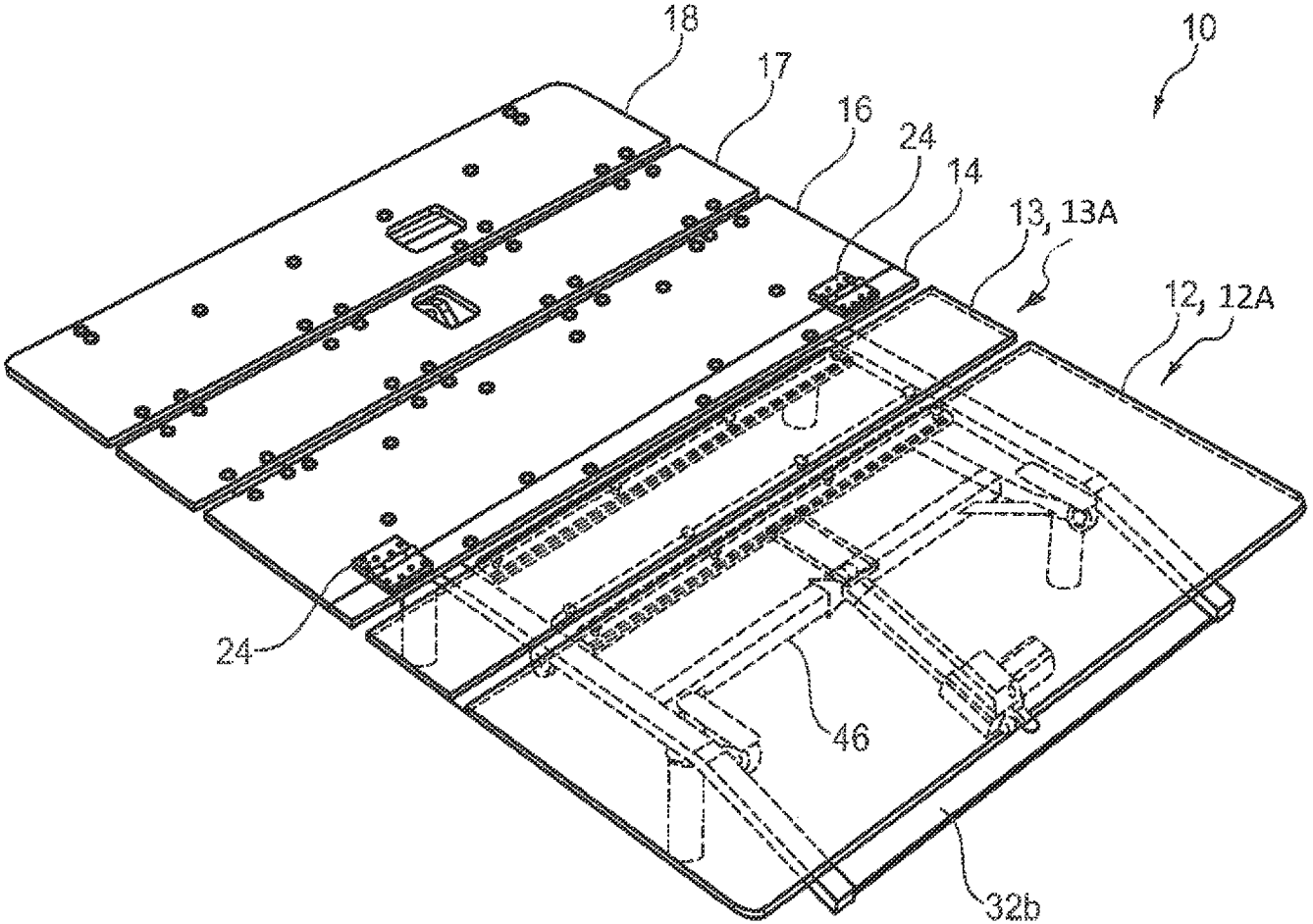
FIG. 7 is a perspective view similar to FIG. 2 with the bed in a fully lowered position, with part of the mattress support deck shown in ghost outline.
Figure 8:
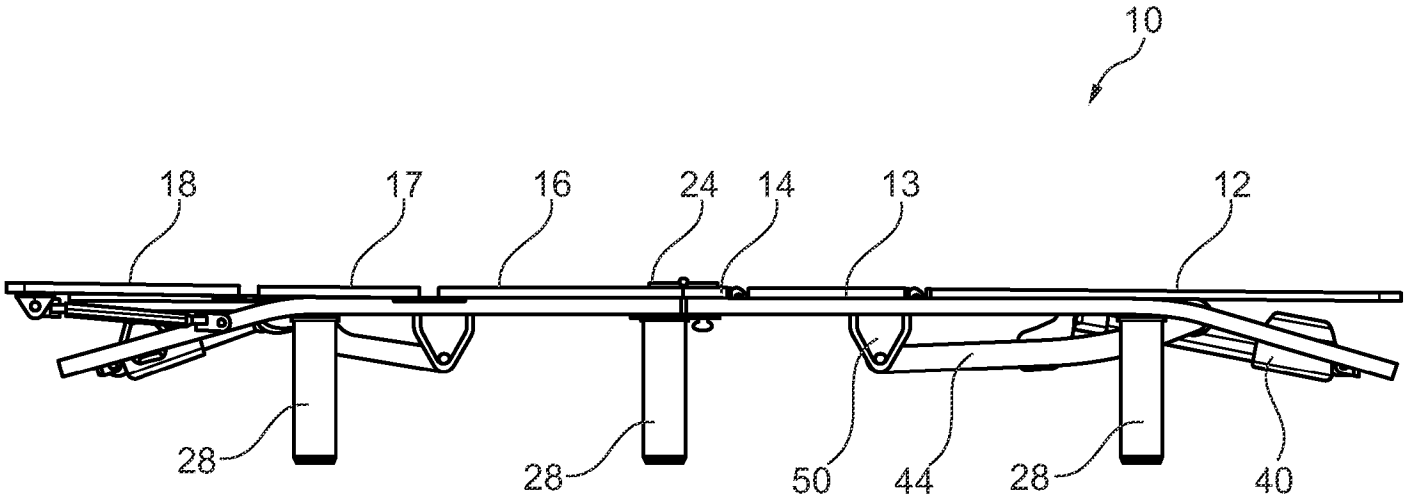
FIG. 8 is a side elevation view of the bed, with the bed in the fully lowered position of FIG. 7.

Actuator 40 is a linear actuator of the Delta-drive type as produced by Dewert-Okin GmbH, having a first end (motor and gear box end) pivotally mounted to the cross member 32*b* and a second end (rod) pivotally connected to a bracket 56 secured to the cross-member 46. The bracket 56 is configured such that the connection between the output rod of the actuator and the bracket 56 is in the plane of the panel 12. This is achieved by means of a cut-out slot 58 in the panel 12 through which the bracket 56 and end of the output rod of the actuator extend. The gearbox and motor end of the actuator 40 is connected to the cross-member 32*b* at a position midway along its length. The cross-member 32*b* is located in a plane lower than the general or notional plane of the frame 20 due to the downwardly canted end of the frame 20*a*. The side members 30*a* are inclined downwards along the final third of their length from a position immediately rearward of the legs 28 attached to the frame 20*a*. The side members are inclined downwards approximately 20 degrees or so, so that the connection point between the actuator 40 and the frame 20*a* is below and offset from the notional plane of the frame 20. This arrangement ensures the actuator is also inclined with respect to the notional plane of the frame and the plane of the panel 12 when the panel 12 is in its lowered position (FIGS. 7 and 8). In combination with the other end of the actuator being in the plane of the panel 12, by means of the bracket 56 and cut out 58, the actuator is able to apply a significant initial force to the panel 12 when the panel is to be raised from is lowered position of FIGS. 7 and 8. It is to be understood that the force component acting on the panel 12 when movement is initiated from its lowered position is dependent on the angular orientation of the actuator force vector with respect to the panel 12. In arrangements where the actuator 12 is oriented more or less horizontal with respect to the panel significant initial force is required to move the panel and any load supported by the panel from its lowered position due to poor leverage, compared with the arrangement of the illustrated embodiment where the component of the actuator force initially acting on the panel is greater due to its relative inclination to the panel 12.

Rotational movement of the panel 12 is thus effected by activation of linear electrical actuator 40 positioned on the underside of the bed within the space envelope of the frame. Thus, panel 12 is raised and lowered by respective extension and retraction of actuator 40. In operation, in the fully lowered configuration of the bed, the adjustable panels 12 and 13 lie flat on the side rails 30*a*, with the output rod of actuator 40 fully retracted towards the respective gearbox end of the actuator. This position is shown in FIGS. 7 and 8. In order to raise the panels 12 and 13, the output rod of the actuator 40 is extended away from the gearbox end of the actuator. Rotational movement of mattress bend support panel 13 is thus simultaneously effected by activation of linear electrical actuator 40. Panels 12 and 13 are this raised and lowered by extension and retraction of actuator 40.

In preferred embodiments, the maximum combined angular adjustment of the panels 12 and 13 is 65 degrees, that is to say the maximum raised inclined angle of the backrest panel 12 with respect to the notional flat horizontal plane of the bed is limited to 65 degrees. This angle of adjustment includes the combined angle of adjustment of the mattress bend support panel 13 with respect to the fixed panel 14 and the angle of adjustment of the backrest panel 12 with respect to the mattress bend support panel 13. The combined angular adjustment may be less, for example, a maximum of 60, 55, 50 degrees or less, and may be contributed by equal amounts of angular adjustment by the panels 13 and 14. The maximum angular adjustment is determined by the geometry of the actuation mechanism including the mounting arrangement and the operation stroke of the actuator as well as the relative length dimensions of the respective adjustable panels.

It is to be understood that a mattress of appropriate thickness, say in the range of 25-50 cm (10-20 inches), is to be positioned on the mattress support platform of the bed 10.

Figure 9:
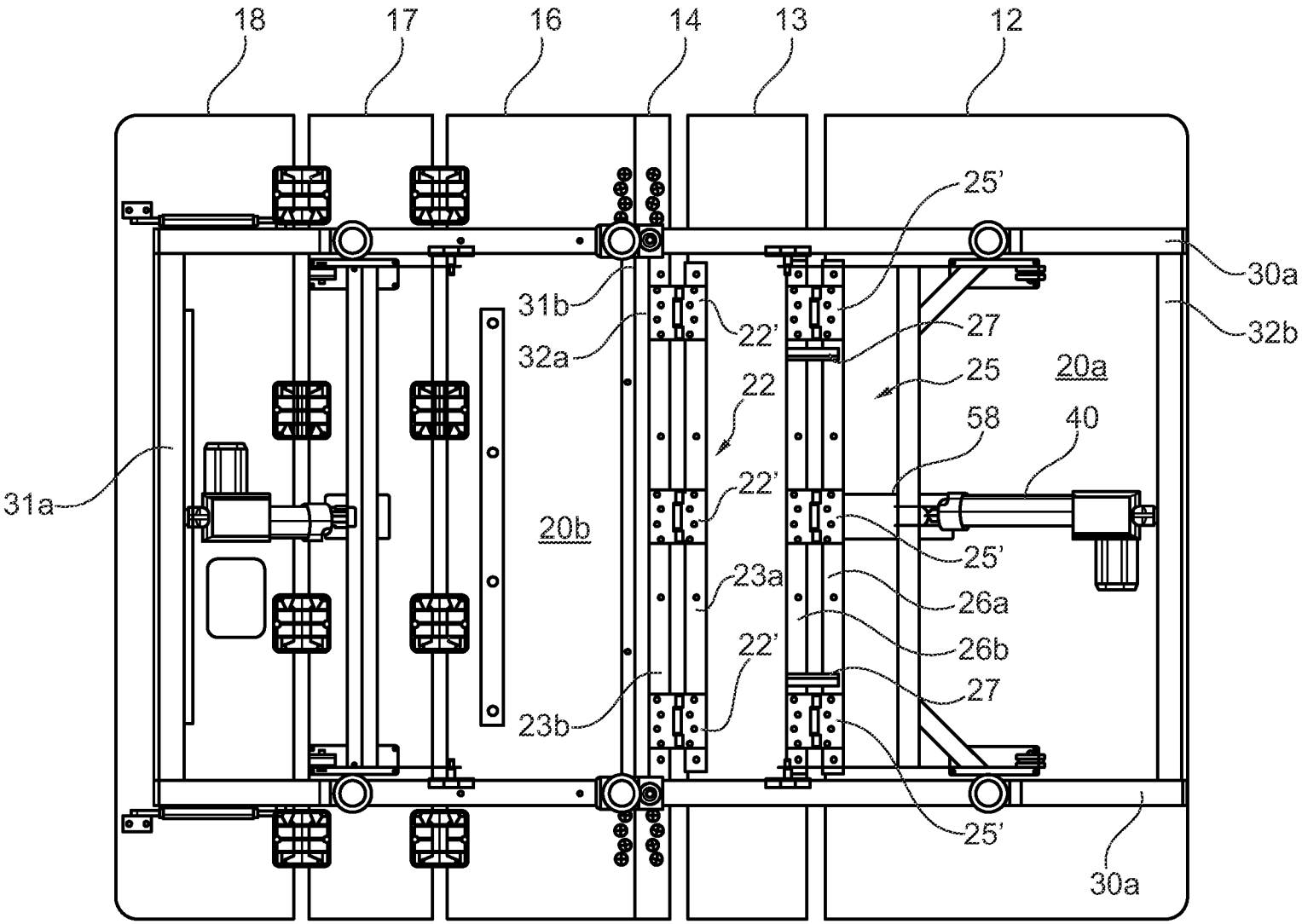
FIG. 9 is a perspective view of the bed of FIG. 1 with the bed viewed from below in plan.

As previously indicated, the frame 20 can be manually folded and unfolded about the traverse hinge axis defined by the hinge elements 24. Either the head end or toe end frame is moved so that the two half sections of the frame are brought together by 10 relative movement about the hinge axis as shown in FIGS. 9 and 10 where the panels 12 and 14 lie flat on top of the panel 16. As can be seen in FIGS. 9 and 10 when the legs 28 are unattached the adjustable bed 10 has a very small space envelope, with half the length dimension of the unfolded bed in exchange for a modest increase in depth, approximately the additional depth of the toe end half frame.

The illustrated embodiment thus provides a foldable adjustable bed in which the frame is divided into at least two hinged sections, preferably two sections, more preferably two half sections. This assists in storage, transportation, display, delivery and installation. An adjustable bed according to the present invention may therefore be more cost effective to ship due to the reduced length dimension of the bed when packaged for shipping, etc. For example. it is envisaged that up to twice of many beds of the above aspect of the invention could be loaded into an ISO container than conventional non-folding adjustable bed designs, thus reducing transportation and storage costs form the place of manufacture though to delivery to the customer's home.

An adjustable bed according to the description above may be assembled on site by simply unfolding the sections of the frame and placing a suitable mattress on the unfolded frame. For example, in a domestic setting a compact package containing the bed may be delivered to a customer's home and readily maneuvered through standard size doorway and hallway apertures into a room where the bed can be unfolded end to end, to provide a full length frame on which a mattress can be placed. This is a significant improvement over hitherto know designs of adjustable beds which typically comprise a kit of parts for assembly at the customer's home. This not only adds to the time of installation, but also requires more skilled labor for delivery and installation. The cost of distribution can be significantly reduced with adjustable beds of the above aspect of the invention, particularly as the bed frame may be transported and delivered as a single item which can be readily deployed for use. It is to be understood that the transportation of such goods by recognized carriers is often charged on a per item basis, hence the present invention also envisages lower distribution costs which has particular advantage in the case of direct sales by ecommerce.

It will be appreciated that references to a mattress include both a separate mattress and a mattress integrated with the support sections or panels.

In the present text, numerous specific details are set forth in order to provide a thorough understanding of exemplary versions of the present invention. It will be apparent, however, to one skilled in the art, that some versions of the present invention may possibly be practiced without some of these specific details. Indeed, reference in this specification to "a variant," "variants," and "one/the variant," or "one version," "a version" and the like, should be understood to mean that a particular feature, structure, or characteristic described in connection with the variant or version is included in at least one such variant or version according to the disclosure. Thus, the appearances of phrases such as "in one variant," "in one version," and the like, in various places in the specification are not necessarily all referring to the same version or variant, nor are separate or alternative versions or variants mutually exclusive of other versions or variants. Moreover, various features may be described which possibly may be exhibited by some variants or versions and not by others. Similarly, various requirements are described which may be requirements for some variants or versions, but not others. Furthermore, as used throughout this specification, the terms 'a', 'an', 'at least' do not denote a limitation of quantity, but rather denote the presence of at least one of the referenced item, in the sense that singular reference of an element does not necessarily exclude the plural reference of such elements. Concurrently, the term "a plurality" denotes the presence of more than one referenced items.

Various operations may be described as multiple discrete operations in turn, in a manner that may be helpful in understanding embodiments of the present invention; however, the order of description should not be construed to imply that these operations are order dependent.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

The invention claimed is:

1. An adjustable bed, comprising:

a frame and an adjustable mattress support platform having a plurality of adjacent articulated rigid mattress support sections each pivotally mounted at a pivotal connection for relative angular adjustment with respect to the frame and a fixed seat section;

said mattress support sections including at least one adjustable backrest support section and at least one adjustable mattress support section adjacent said at least one adjustable backrest support section;

a single actuator for effecting simultaneous coordinated pivotal only movement to angularly adjust the at least one adjustable backrest support section relative tothe at least one adjustable mattress support section for reconfiguring the bed between a flat lowered configuration and a raised configuration for supporting an occupant in a flat lowered or a raised position;

wherein an interior angle between an upper face of the mattress support section and an upper face of the at least one adjustable backrest support section is less than 180 degrees when the adjustable bed is between the flat lowered configuration and the raised configuration;

wherein the single actuator has connecting means and at a distal end includes at least one roller mounted thereon operable to drive the at least one adjustable backrest support section;

the at least one adjustable backrest support section being linearly moveable relative to, and pivotally along the roller at the distal end to effect pivotal movement of the at least one adjustable mattress support section;

wherein the actuator is operable to act simultaneously on the at least one adjustable backrest support section and the at least one adjustable mattress support section to reconfigure the bed between the flat lowered configuration and the raised position; and the angular range of adjustment of said at least one adjustable backrest support section and said at least one adjustable mattress support section is limited by stop means associated with each of the respective pivotal connections of the at least one backrest support section and said at least one adjustable mattress support section.

2. The adjustable bed, according to claim 1, wherein:

the pivotal movement of the at least one adjustable backrest support section relative to the at least one adjustable mattress support section is dependent on the position of an external load on the mattress support platform relative to the distal end of the connecting means.

3. The adjustable bed, according to claim 1, wherein:

a combined angle is defined between a plane defined by the seat section and a plane defined by the at least one adjustable backrest support section, the combined angle being shared between a first angle defined between the plane defined by the seat section and a plane defined by the at least one adjustable mattress support section, and a second angle defined between the plane defined by the at least one adjustable mattress support section and the plane defined by the at least one adjustable backrest support section, wherein the combined angle is substantially 65 degrees or less with respect to the flat lowered configuration of the bed.

4. The adjustable bed, according to claim 1, wherein:

the angular range of adjustment of said at least one adjustable backrest support section and the angular range of adjustment of said at least one adjustable mattress support section are substantially equal.

5. The adjustable bed, according to claim 1, wherein:

the angular range of adjustment of said at least one adjustable backrest support section is greater than the angular range of adjustment of said at least one adjustable mattress support section.

6. The adjustable bed, according to claim 1, wherein:

said at least one adjustable mattress support section comprises a plurality of adjacent adjustable mattress support sections.

7. The adjustable bed, according to claim 1, wherein:

said at least one adjustable backrest support section comprises a plurality of adjacent adjustable backrest support sections.

8. The adjustable bed, according to claim 1, wherein:

said mattress support platform further comprises at least one non-adjustable support section fixed in relation to the fra me.

9. The adjustable bed, according to claim 8, wherein:

said at least one adjustable mattress support section is disposed between said at least one non-adjustable mattress support section and said at least one adjustable backrest support section.

10. The adjustable bed, according to claim 1, wherein:

said at least one adjustable backrest support section and at least one adjustable mattress support section have a combined angle of angular adjustment of substantially 65 degrees with respect to the flat lowered configuration of the bed.

11. The adjustable bed, according to claim 3, wherein:

the combined range of adjustment of said at least one adjustable backrest support section and said at least one adjustable mattress support section is 65 degrees or less with respect to the flat lowered configuration of the bed.

12. The adjustable bed, according to claim 11, wherein:

the combined range of adjustment of said at least one adjustable backrest support section and said at least one adjustable mattress support sections is 60 degrees or less with respect to the flat lowered configuration of the bed.

13. The adjustable bed, according to claim 12, wherein:

the combined range of adjustment of said backrest support section and mattress support section is 55 degrees or less with respect to the flat lowered configuration of the bed.

14. An adjustable bed, comprising:

a frame and an adjustable mattress support platform having a plurality of adjacent articulated rigid mattress support sections each pivotally mounted at a respective pivotal connection for relative angular adjustment with respect to the frame and a fixed seat section;

said mattress support sections including at least one adjustable backrest support section and at least one adjustable mattress support section adjacent said at least one adjustable backrest support section;

a single actuator for effecting coordinated pivotal only movement and to simultaneously angularly adjust the at least one adjustable backrest support section and the at least one adjustable mattress support section relative to one another and the frame an for reconfiguring the bed between a flat lowered configuration and a raised configuration for supporting an occupant in a flat lowered or a raised position;

wherein an interior angle between an upper face of the at least one adjustable mattress support section and an upper face of the at least one adjustable backrest support section is less than 180 degrees when the bed is between the flat lowered configuration and the raised configuration; and wherein the range of adjustment of said at least one adjustable backrest and said at least one adjustable mattress support section is limited by stop means associated with each of the respective pivotal connections of the at least one adjustable backrest support section and said at least one adjustable mattress support section;

wherein the single actuator has connecting means and at a distal end includes at least one roller mounted thereon operable to drive the at least one adjustable backrest support section; and the at least one adjustable backrest support section being linearly moveable relative to, and pivotally along the roller at the distal end to effect pivotal movement of the at least one adjustable mattress support section.

15. An adjustable bed, comprising:

a frame and an adjustable mattress support platform having a plurality of adjacent articulated rigid mattress support sections each pivotally mounted at a respective pivotal connection for relative angular adjustment with respect to the frame and a fixed seat section;

said mattress support sections including at least one adjustable backrest support section and at least one adjustable mattress support section adjacent said at least one adjustable backrest support section;

a single actuator for effecting coordinated pivotal only movement and to simultaneously angularly adjust the at least one adjustable backrest support section relative tothe at least one adjustable mattress support section for reconfiguring the bed between a flat lowered configuration and a raised configuration for supporting an occupant in flat or a raised position;

wherein an interior angle between an upper face of the at least one adjustable mattress support section and an upper face of the at least one adjustable backrest support section is less than 180 degrees when the bed is between the flat lowered configuration and the raised configuration; and wherein the range of adjustment of said at least one adjustable backrest support section and said at least one adjustable mattress support section is limited by a limiting hinge associated with each of the respective pivotal connections of the at least one adjustable backrest support section and at least one adjustable mattress support section;

wherein the single actuator has connecting means and at a distal end includes at least one roller mounted thereon operable to drive the at least one adjustable backrest support section; and the at least one adjustable backrest support section being linearly moveable relative to, and pivotally along the roller at the distal end to effect pivotal movement of the at least one adjustable mattress support section and the at least one adjustable backrest support section.

16. An adjustable bed, comprising:

a frame and an adjustable mattress support platform having a plurality of adjacent articulated rigid mattress support sections each pivotally mounted at a respective pivotal connection for relative angular adjustment with respect to the frame and a fixed seat section;

said mattress support sections including at least one adjustable backrest support section and at least one adjustable mattress support section adjacent said adjustable backrest support section;

a single actuator for effecting coordinated pivotal only movement and to simultaneously angularly adjust the at least one adjustable backrest support section and the at least one adjustable mattress support section relative to one another and the frame for reconfiguring the bed between a flat lowered configuration and a raised configuration for supporting an occupant in a flat or a raised position;

wherein an interior angle between an upper face of the at least one adjustable mattress support section and an upper face of the at least one adjustable backrest support section is less than 180 degrees when the bed is between the flat lowered configuration and the raised configuration;

wherein the range of adjustment of said at least one adjustable backrest support section and said at least one adjustable mattress support section is limited by a limiting hinge associated with each of the respective pivotal connections of the at least one adjustable backrest and at least one adjustable mattress support section;

wherein a connecting means includes a pair of arms and a cross-member extending between and connecting the arms such that each arm is operable to drive the backrest support section;

wherein the single actuator has connecting means and at a distal end includes at least one roller mounted thereon operable to drive the at least one adjustable backrest support section; and the at least one adjustable backrest support section being linearly moveable relative to, and pivotally along the roller at the distal end to effect pivotal movement of the at least one adjustable mattress support section.

17. An adjustable bed, comprising:

a frame and an adjustable mattress support platform having a plurality of adjacent articulated rigid mattress support sections pivotally mounted for relative angular adjustment with respect to the frame and a fixed seat section;

said mattress support sections including at least one adjustable backrest support section and a single adjustable mattress support section adjacent said at least one adjustable backrest support section;

a single actuator for effecting coordinated pivotal only movement and to simultaneously angularly adjust the adjustable backrest support section and the single adjustable mattress support section relative to one another and the frame for reconfiguring the bed between a flat lowered configuration and a raised configuration for supporting an occupant in a flat lowered or a raised position;

wherein an interior angle between an upper face of the adjustable mattress support section and an upper face of the at least one adjustable backrest support section is less than 180 degrees when the adjustable bed is between the flat lowered configuration and the raised configuration;

wherein the range of adjustment of said at least one adjustable backrest support section and said adjustable mattress support section is limited by a stop means associated with each of the respective pivotal connections of the at least one adjustable backrest support sections and said adjustable mattress support section;

wherein the single actuator has connecting means and at a distal end includes at least one roller mounted thereon operable to drive the at least one adjustable backrest support section; and the at least one adjustable backrest support section being linearly moveable relative to, and pivotally along the roller at the distal end to effect pivotal movement of the at least one adjustable mattress support section.

18. An adjustable bed, according to claim 1, wherein:

said connecting means further comprises:

a pair of arms and a cross-member extending between said arms;

each arm including said roller mounted on said distal end; and each arm being operative to drive said backrest support section.

* * * * *